US009073312B2

(12) United States Patent
Rosello et al.

(10) Patent No.: US 9,073,312 B2
(45) Date of Patent: Jul. 7, 2015

(54) PRINTING WITH MULTIPLE PRINTHEAD DIES

(75) Inventors: Lluis Abello Rosello, Tarragona (ES); Joan Vidal Fortia, Barcelona (ES); Ron Burns, San Diego, CA (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 0 days.

(21) Appl. No.: 14/391,581

(22) PCT Filed: May 23, 2012

(86) PCT No.: PCT/US2012/039055

§ 371 (c)(1),
(2), (4) Date: Oct. 9, 2014

(87) PCT Pub. No.: WO2013/176661

PCT Pub. Date: Nov. 28, 2013

(65) Prior Publication Data

US 2015/0062218 A1 Mar. 5, 2015

(51) Int. Cl.

| | |
|---|---|
| ***B41J 29/393*** | (2006.01) |
| ***B41J 2/045*** | (2006.01) |
| ***B41J 2/21*** | (2006.01) |
| ***B41J 11/44*** | (2006.01) |
| ***B41J 2/155*** | (2006.01) |

(52) U.S. Cl.

CPC ..... *B41J 2/04541* (2013.01); *B41J 2/04505* (2013.01); *B41J 2/04506* (2013.01); *B41J 2/04558* (2013.01); *B41J 2/2132* (2013.01); *B41J 2/2135* (2013.01); *B41J 2/04573* (2013.01); *B41J 11/44* (2013.01); *B41J 2/155* (2013.01)

(58) Field of Classification Search

CPC ..... B41J 2/04541; B41J 2/04573; B41J 2/04506; B41J 11/44; B41J 2/04558; B41J 2/2135; B41J 2/2132; B41J 2/04505; B41J 2/155

See application file for complete search history.

(56) References Cited

U.S. PATENT DOCUMENTS

| | | | | |
|---|---|---|---|---|
| 5,600,351 | A | 2/1997 | Holstun et al. | |
| 5,923,344 | A | 7/1999 | Norum et al. | |
| 6,338,544 | B1 | 1/2002 | Drake et al. | |
| 6,749,279 | B2 | 6/2004 | Kobayashi et al. | |
| 6,824,239 | B1 | 11/2004 | Hanabusa et al. | |
| 7,637,580 | B2 | 12/2009 | Shamoun et al. | |
| 2004/0061730 | A1 | 4/2004 | Askeland et al. | |
| 2006/0170716 | A1 | 8/2006 | Reyero et al. | |
| 2010/0141701 | A1 * | 6/2010 | Aruga | 347/16 |
| 2011/0074860 | A1 * | 3/2011 | Saettel et al. | 347/19 |
| 2012/0086745 | A1 * | 4/2012 | Moriai et al. | 347/6 |

FOREIGN PATENT DOCUMENTS

KR 10-0788664 B1 12/2007

OTHER PUBLICATIONS

International Searching Authority, International Search Report and Written Opinion, PCT/US2012/039055, 9 pages, Mailing Date Feb. 15, 2013.

* cited by examiner

*Primary Examiner* — Julian Huffman

(57) ABSTRACT

A method and apparatus for printing is disclosed. The printing is done with multiple printhead dies. The nozzles in the different printhead dies are fired using different phases in an up-sampled encoder signal. The different phases correspond to a print offset between the different printhead dies.

12 Claims, 3 Drawing Sheets

PRINTING WITH MULTIPLE PRINTHEAD DIES

BACKGROUND

Many inkjet printers use multiple printhead dies to print multiple colors each pass. The multiple printhead dies may be mounted in a carriage that scans back-and-forth across the media or in a page wide array (PWA).

DETAILED DESCRIPTION

FIGS. 1-5 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Inkjet printers typically have one or more printhead dies where each printhead die has an array of nozzles. The printhead dies and media are moved relative to each other. In page wide array printers, the media is moved past the page wide array of print dies. Other inkjet printers have the print dies mounted on a carriage that moves hack and forth across the media width while printing swaths of ink. The media is then advanced between the different swaths. In both cases the direction of motion between the printhead dies and the media is called the print direction. The spacing or resolution of the ink drops on the paper in the print direction is determined by the frequency of firing pukes sent to the printhead die and the speed the media is moving with respect to the printhead dies. The spacing or resolution of the ink drops on the paper in the axis perpendicular to the print axis is determined by the nozzle spacing on the printhead die and the number of nozzles used.

Figure 1:
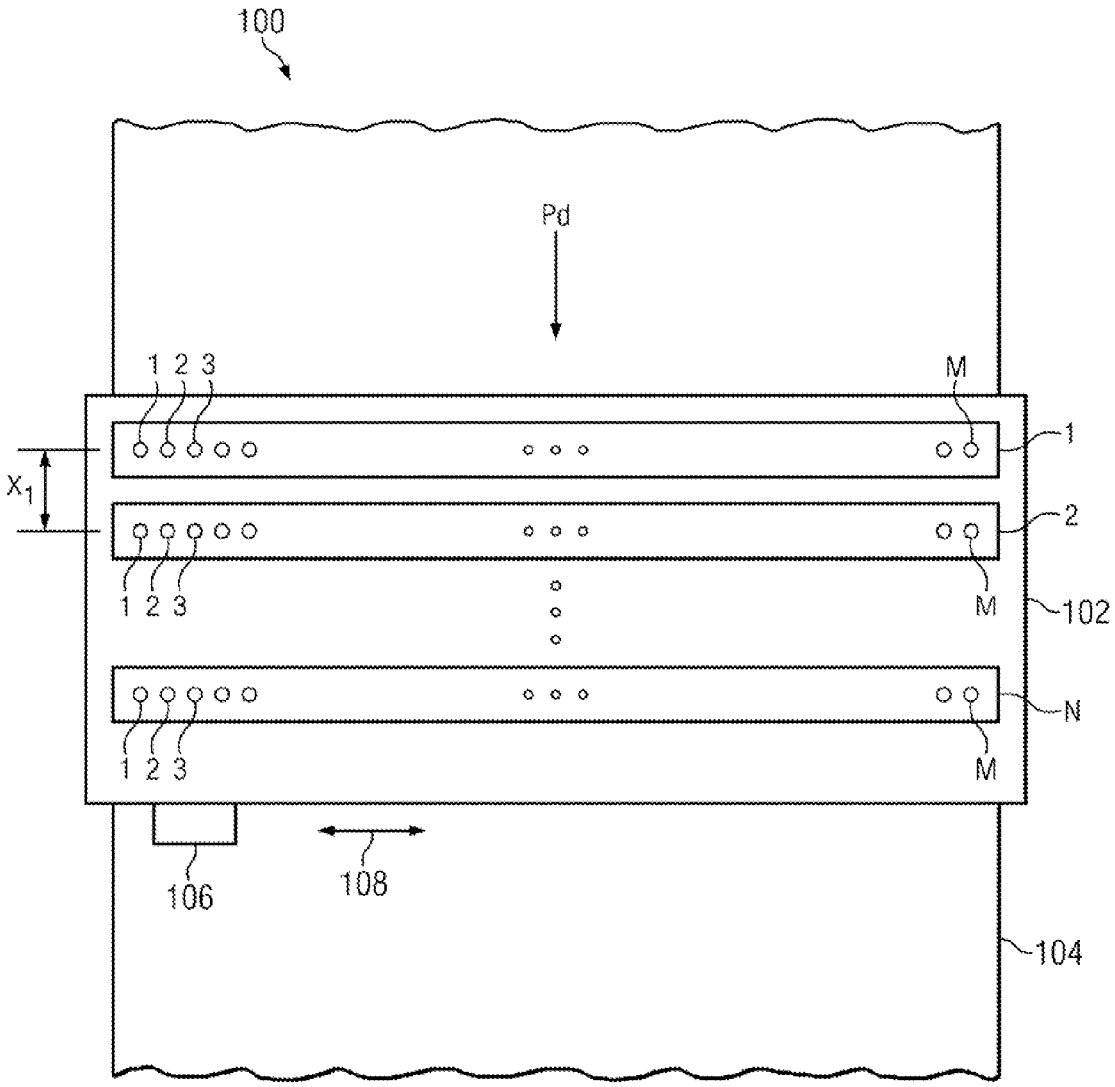
FIG. 1 is a top view of a printer 100 in an example embodiment of the invention.

FIG. 1 is a top view of a printer 100 in an example embodiment of the invention. Printer 100 is a page wide array primer with a print bar 102 extending across the width of the media 104. Media 104 is moved in the print direction shown by arrow PD. Print bar has multiple printhead dies numbered 1-N. Each printhead die may be used to print ink of one color onto media 104, for example cyan, yellow, magenta or black. There may be multiple printhead dies used to print the same color. Each printhead die has a row of nozzles numbered 1-M. Each nozzle can dispense ink drops onto media 104. A real printer would have more than one row of nozzles in each printhead die and may have multiple colors, but for clarity the number of rows of nozzles has been reduced. A sensor 106 is attached to print bar 102 and can be moved in an axis (shown by arrow 108) perpendicular to the print direction. Sensor 106 can be used to measure the position of the drops of ink deposited on media 104. In other examples, an external sensor may be used to measure the position of ink drops on the media.

The alignment of ink drops on the media from different printhead dies is affected by the spacing between the rows of nozzles in the different printhead dies and the speed the media is moving with respect to the printhead dies. The spacing in the print direction between the nozzles in the different printhead dies is X1. Distance X1 may vary due to manufacturing tolerance such that the spacing between the nozzles in the different printhead dies is non-uniform. For example, the spacing between the nozzles in printhead die 2 and printhead die 3 may be X1+delta, and the spacing between the nozzles in printhead the 3 and printhead die 4 may be X1−delta. The alignment of ink drops from different printhead dies can also be affected by media stretch or shrinkage due to wetting by the ink, drying, media tension variations, media speed variations and the like. By measuring the ink drop location on the media from the different printhead dies, the firing pulses for the nozzles in the different printhead dies can be aligned/calibrated such that the drops from the different printhead dies align.

Figure 2:
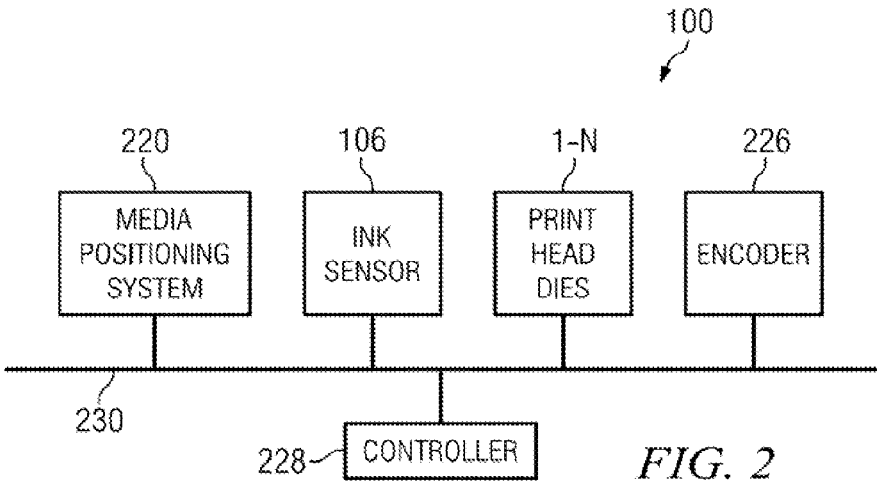
FIG. 2 is a block diagram of printer in an example embodiment of the invention.

FIG. 2 is a block diagram of printer 100 in an example embodiment of the invention. Printer 100 comprises a media positioning system 220, ink sensor 106, printhead dies 1-N, an encoder 226, a controller 228, and communication bus 230. Media positioning system 220 may comprise drums, motors, sensors, feed rollers, take-up rollers and the like. Controller 228 may comprise one or more processors, an application specific integrated circuit (ASIC), memory, input/output circuitry and the like. Communication bus 230 may be any type of communication bus, for example USB. Controller 228 is coupled to media positioning system 220, ink sensor 106, printhead dies 1-N, and encoder 226 through bus 230. Memory in controller 228 may comprise both volatile and non-volatile memory. Code, stored in the memory, when executed by a processor on controller 228, causes printer 100 to take actions, for example printing ink on media 104.

Encoder 226 may be a 150 dpi quadrature encoder and output a 150 dpi encode signal. When using all 4 edges of the 150 dpi encoder signal a 600 dpi encode signal is generated. The output from encode 226 is used to derive the firing pulses for the different printhead dies. Printers typically print at multiple resolutions. For high quality jobs a printer may print at its native resolution, for example 1200 dots per inch (DPI). For high speed or lower quality jobs, the printing resolution may be 600 DPI. For draft modes the printing resolution may only be 300 to 150 DPI. The resolution for each print job is selected before the start of the print job. Once the print job resolution has been selected, the encoder signal will be up-sampled to a higher than priming resolution signal. For example, when printing at 600 dpi the encode signal will be up-sampled by 4× to 2400 dpi. The up-sampled 2400 dpi signal will be used to align the firing between the different printhead dies to sub-pixel accuracy at the printing resolution.

Figure 3:
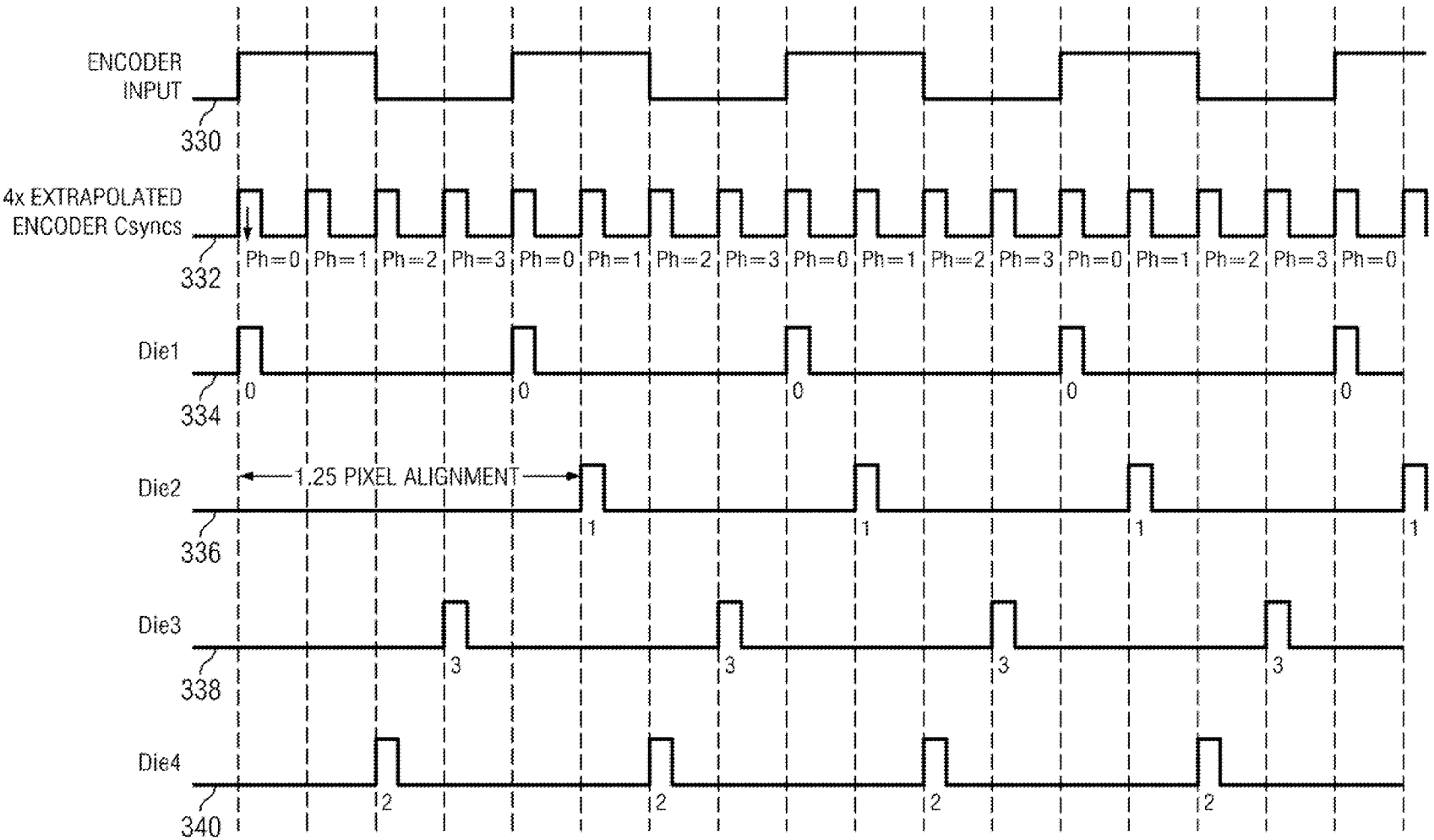
FIG. 3 is a timing diagram for printing at 600 dpi, in an example embodiment of the invention.

FIG. 3 is a timing diagram for printing at 600 dpi, in an example embodiment of the invention. In FIG. 3, line 330 is the base encoder signal running at 600 dpi. Line 332 is an up-sampled encoder signal. In this example the base encoder signal has been up-sampled by 4×, so the up-sampled encoder signal 332 is at 2400 dpi. Lines 334, 336, 338 and 340 shows the firing pulses for printhead dies 1, 2, 3 and 4 respectively. The firing, pulses in lines 334, 336, 338 and 340 are the column sync signal for printhead dies 1, 2 and 4 respectively. The column sync for die 1 is aligned to phase 0 of the up-sampled encoder signal in line 332. The column sync for die 2 is aligned to phase 1 of the up-sampled encoder signal in line 332. This means die 2 will print dots of ink offset by $1/2400^{th}$ of an inch relative to dots of ink printed by die 1. $1/2400^{th}$ of an inch is ¼ of a pixel at the 600 dpi printing resolution.

The column sync for die 3 is, aligned to phase 3 of the up-sampled encoder signal in line 332. This means die 3 will print dots of ink offset by $3/2400^{th}$ of an inch relative to dots of ink printed by die 1. The column sync for die 4 is aligned to phase 2 of the up-sampled encoder signal in line 332. This means die 4 will print dots of ink offset by $2/2400^{th}$ of an inch relative to dots of ink printed by die 1. Using this method, the ink drops from each printhead die can be aligned to sub-pixel accuracy at the print resolution. in one example embodiment of the invention, the up-sample rate is fixed and is independent of the print resolution. For example the encoder signal is always up-sampled by a factor of 4 so that the ink dots are aligned to within ¼ of the print resolution.

In another example embodiment of the invention, the up-sample rate is variable and is dependent on the print resolution. In this example, the up-sample rate would increase with decreasing print resolution. This could maintain the ink drop alignment between printhead dies at a constant physical distance. For example, when printing at 600 dpi, the up-sample rate may be 4× and when printing at 300 dpi the up-sample rate would be 8×. In each case the alignment between drops of in printed by two different printhead dies would be $1/2400^{th}$ of an inch. This would be ¼ of a pixel at 600 dpi and ⅛ of a pixel at 300 dpi.

The selected phase of the up-sampled encoder signal for two printhead dies corresponds to a print offset between ink drops printed from the two printhead dies. The print offset between two printhead dies can be determined in the following way. One or more ink drops are printed by each of the two printhead dies using the encoder signals for each printhead die that should align the ink drops deposited on the media. The distance between the nozzles in the two printhead dies and the media speed past the printhead dies affect the alignment of the ink on the media. In some instances, the encoder signal for each printhead die that should align ink drops from the two printhead dies ma not be in the same phase. The ink drops that should align are printed and then the location or position of the ink drops on the media are measured. During a long print job, conditions in the printer and/or the media may change such that the encoder signals that should align the ink drops from the two printhead dies no longer align the ink drops from the two printhead dies.

Figure 4:
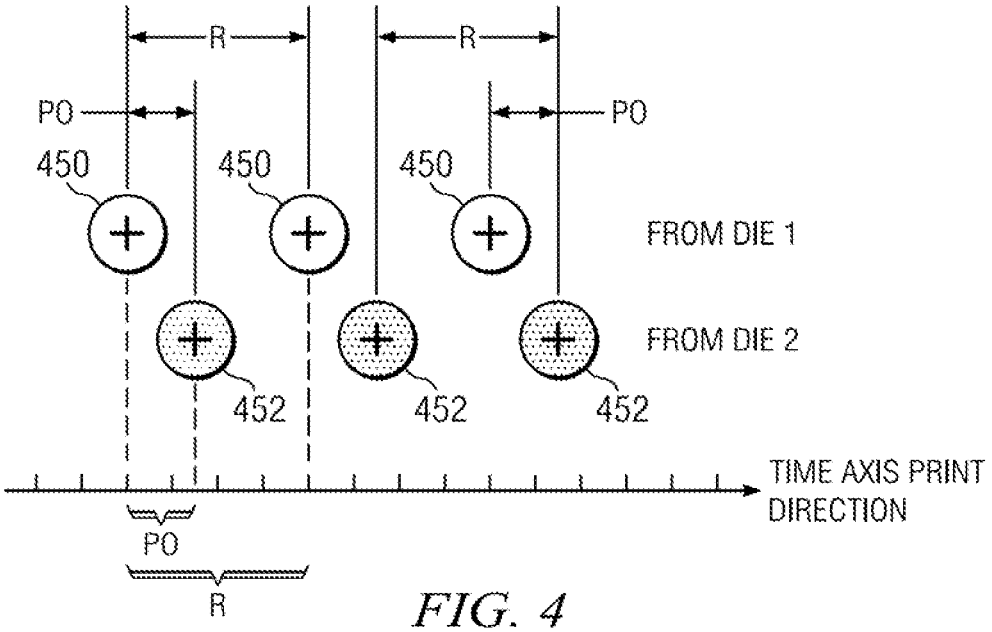
FIG. 4 shows ink drops printed from two printhead dies in an example embodiment of the invention.

The position of the ink drops are measured using an ink sensor. The print offset corresponds to the miss-alignment between the ink drops printed by the two printhead dies. FIG. 4 shows ink drops printed from two printhead dies in an example embodiment of the invention. Ink drops 450 have been printed from printhead die 1. Ink drops 452 have been printed from printhead die 2. Both printhead dies are printing at the same resolution which corresponds to a spacing between ink drops of distance R. A time axis/print direction is running along the bottom of FIG. 4 with increments of ¼ R. The ink drops or dots from the two printhead dies should be aligned vertically. The ink drops from printhead die 1 are offset from printhead die 2 by distance PO. Distance PO is the print offset. In this example the print: offset (distance PO) corresponds to approximately ⅜ R.

When the encoder signal is up-sampled by a factor of 4 from the print resolution, the miss-alignment between print dies can be corrected within ¼ of the print resolution. The print resolution in FIG. 4 is R. To align the ink drops in FIG. 4 the nozzles from die 1 (in FIG. 4) will be fired at phase 1 and the nozzles in die 2 will be fired at phase 0. This will shift the positions of the drops from die 1 by ¼ R to the right with respect to the ink drops from die 2. Once the ink drops have been shifted, the ink drops from die 1 will be aligned to within ¼ R to the ink drops from die 2. If the encoder signal in FIG. 4 was up-sampled by a factor of 8, the miss-alignment between print dies could be corrected to within ⅛ of the print resolution or ⅛ of R. In this case the nozzles from die 1 (in FIG. 4) will be fired at phase 3 and the nozzles in die 2 will be fired at phase 0. This will shift the positions of the drops from die 1 by ⅜ R to the right with respect to the ink drops from die 2. Once the ink drops have been shifted, the ink drops from die 1 will be aligned to within ⅛ of R to the ink drops from die 2

The print offset between two printhead, dies can be measured by printing drops in a number of different locations. In some examples the ink drops are measured by looking at ink deposited in a page or image being printed. In other examples, the ink drops to be measured may be deposited between pages or in the margin alongside pages being printed. Because the ink drops can be measured in these different locations, the print offset between printhead dies can be updated dynamically during a print job. This allows the alignment between printhead dies to be adjusted on a per page bases, if needed. In some examples, the alignment between printhead dies may be updated on a periodic time period or at the start of each print job. In other examples, the alignment between printhead dies may be updated whenever the print offset exceeds a threshold value.

Figure 5:
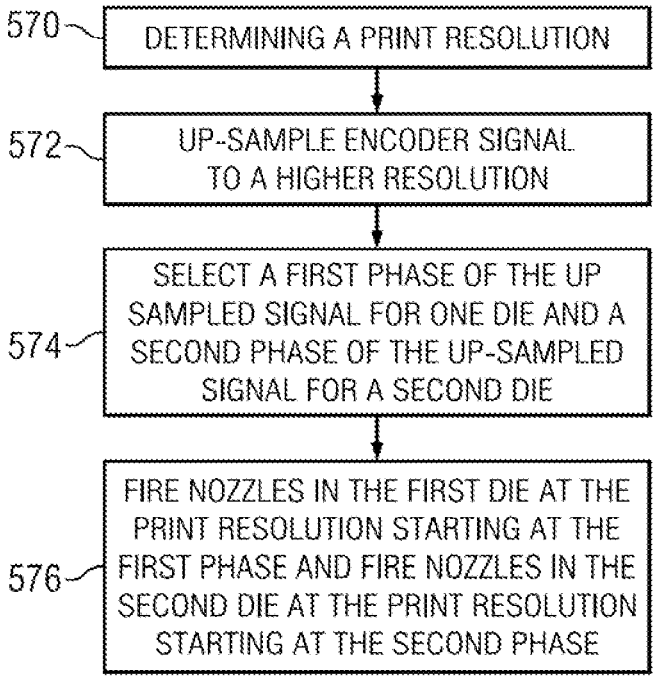
FIG. 5 is a flow chart for printing with multiple printhead dies in an example embodiment of the invention.

FIG. 5 is a flow chart for printing with multiple printhead dies in an example embodiment of the invention. At step 570 a print resolution in a printing axis is determined. At step 572 an encoder signal is up-sampled to a higher than print resolution. At step 574 the firing phase in the up-sampled encode signal is selected for a first one of the two printhead dies to be aligned. And the firing phase in the up-sampled encode signal is selected for the second of the two printhead dies to be aligned. At step 576 the nozzles in the first printhead die are fired at the printing resolution, starting at the firing phase for the first die. The nozzles in the second printhead die are fired at the printing resolution, starting at the firing phase for the second die.

The examples above describe adjusting, the alignment of printhead dies using a pave wide array printer. Adjusting the alignment of printhead dies using this method may also be done for inkjet printers that have printhead dies moving across the media in a carriage.

What is claimed is:

1. A printer, comprising:

at least two printhead dies in a spaced apart relationship, where each printhead die comprises a plurality of nozzles;

an encoder that provides an encoder signal;

a controller coupled to the two printhead dies and the encoder, the controller to control the printer;

the controller to up-sample the encoder signal to higher than a print resolution in a print direction;

the controller to select a first one of the up-sampled encoder signal phases for a first one of the at least two printhead dies;

the controller to select a second one of the up-sampled encoder signal phases for a second one of the at least two printhead dies, wherein the difference between the first one and the second one of the up-sampled encoder signal phases corresponds to a print offset between the first printhead die and the second printhead die;

the controller to fire nozzles in the first printhead die at the print resolution beginning at the first one of the up-sampled encoder signal phases;

the controller to fire nozzles in the second printhead die at the print resolution beginning at the second one of the up-sampled encoder signal phases.

2. The printer of claim 1, further comprising:

an ink sensor, the ink sensor to sense the position of ink, deposited on media loaded in the printer, by the at least two printhead dies;

the controller coupled to the ink sensor, the controller to determine the print offset from the position of the ink on the media.

3. The printer of claim 2, wherein the controller determines the print offset periodically.

4. The printer of claim 3, wherein the controller re-selects the first one and the second one of the up-sampled encoder signal phases when the print offset exceeds a threshold value.

5. The printer of claim 2, wherein the controller uses ink drops printed in the margins of the page to determine the print offset.

6. The printer of claim 1, wherein the controller uses an up-sample rate when the controller up-samples the encoder signal to higher than the print resolution, and the up-sample rate is selected from the following group of up-sample rates: 4×, 6×, 8×, 10×, 12×, 16×, 32×, 64× and 128×.

7. The printer of claim 1, wherein the controller uses an up-sample rate when the controller up-samples the encoder signal to higher than the print resolution, and the up-sample rate is dependent on the print resolution.

8. A method for printing, comprising determining a print resolution in a print axis;

up-sampling an encoder signal to higher than the print resolution;

determining a print offset between a first printhead die and a second printhead die;

selecting a first one of the up-sampled encoder signal phases for the first printhead die;

selecting a second one of the up-sampled encoder signal phases for the second printhead die, wherein the difference between the first one and the second one of the up-sampled encoder signal phases corresponds to the print offset;

firing nozzles in the first printhead die at the print resolution starting at the first one of the up-sampled encoder signal phases;

firing nozzles in the second printhead die at the print resolution starting at the second one of the up-sampled encoder signal phases.

9. The method of claim 7, where the print resolution is less than a native resolution in the print axis.

10. The method of claim 7, wherein determining the print offset between the first printhead die and the second printhead die is done during a print job.

11. The method of claim 7, wherein determining the print offset between the first printhead die and the second printhead die is done using ink printed between pages in a print job.

12. The method of claim 7, further comprising:

determining a print offset between the second printhead die and a third printhead die;

selecting a third one of the up-sampled encoder signal phases for the third printhead die, wherein the difference between the second one and the third one of the up-sampled encoder signal phases corresponds to the print offset between the second printhead die and a third printhead die;

firing nozzles in the third printhead die at the print resolution starting at the third one of the up-sampled encoder signal phases.

* * * * *